United States Patent [19]

Hesse

[11] Patent Number: 5,035,655

[45] Date of Patent: Jul. 30, 1991

[54] LIGHT BULB RECEPTACLE AND METHOD OF ASSEMBLY

[75] Inventor: Louis D. Hesse, Chicago, Ill.

[73] Assignee: Phoenix Lighting Products Corporation, Chicago, Ill.

[21] Appl. No.: 382,537

[22] Filed: Jul. 18, 1989

[51] Int. Cl.[5] ..... H01R 17/00

[52] U.S. Cl. ..... 439/699; 439/879; 439/885

[58] Field of Search ..... 439/877-882, 439/619, 699, 220, 280, 336, 356, 360, 375, 280, 745, 746, 747, 748, 387, 885

[56] References Cited

U.S. PATENT DOCUMENTS

| | | | |
|---|---|---|---|
| 2,104,786 | 1/1938 | Andre | 439/879 |
| 2,806,215 | 9/1957 | Redslob . | |
| 3,283,286 | 11/1966 | Webb et al. | 439/699 |
| 3,320,574 | 5/1967 | Touchel | 439/850 |
| 3,568,137 | 3/1971 | Youngblut . | |
| 3,654,594 | 4/1972 | Sitzler . | |
| 3,711,819 | 1/1973 | Mathews | 439/748 |
| 3,936,131 | 2/1976 | Durand | 439/746 |
| 4,114,972 | 9/1978 | Kraus et al. | 439/375 |
| 4,209,221 | 6/1980 | Chupak . | |
| 4,592,615 | 6/1986 | Durand | 439/699 |
| 4,752,241 | 6/1988 | Matsuoka et al. | 439/747 |

*Primary Examiner*—David L. Pirlot

*Attorney, Agent, or Firm*—Jacques M. Dulin; Thomas C. Feix

[57] ABSTRACT

Bulb receptacle assembly and method and apparatus for assembling the bulb receptacle. The bulb receptacle assembly comprises a housing having one open end to receive a bulb base, and a second open end to receive a pair of spaced bulb clamps disposed in the housing. Each bulb clamp engages a terminal of the light bulb. Each clamp is fabricated separately from heat-treated spring steel for excellent mechanical strength to permit frequent insertion and removal of the bulb. To provide the necessary good electrical contact, the clamp is secured to a bared wire conductor by a ductile strap, preferably of brass, that is crimped around a tang of the clamp and the bared wire conductor. The assembly apparatus includes a vibration device that dispenses each clamp individually in proper orientation to engage the strap in a crimp station. A ribbon-reel feeds a continuous ribbon of joined straps to the crimp station. Bared wire conductor ends are fed to the crimp station where wire, strap and clamp are crimped together.

9 Claims, 3 Drawing Sheets

LIGHT BULB RECEPTACLE AND METHOD OF ASSEMBLY

BACKGROUND

1. Field:

This invention relates to electrical contact assemblies for small light bulbs, such as miniature and sub-miniature bulbs used for computer console boards, automotive applications, displays etc., and more particularly to systems including a bulb to wire contactor that is amenable to assembly by high-speed automated or semi-automated production techniques.

2. Prior Art:

With the proliferation of devices requiring electrical connection such as wires in wire-to-wire assemblies, switches, light bulbs, integrated circuit chips, spark plugs etc., there continues to develop a demand for connectors and contactors that are especially adapted to meet requirements of economy, convenience and reliability. In the context of the art discussed here, "connector" means devices wherein electrical conductivity is a primary requirement such as wire-to-wire unions, chips to boards, switches etc., whereas "contactors" means devices wherein mechanical strength is a primary consideration and conductivity is secondary, needing only to be adequate for service requirements, such as bulb sockets.

The common requirement for all contactors is to maintain good electrical conductivity and mechanical strength that is not diminished by time or frequent separation and connection. Different purposes or uses demand different construction of the various contactors. For example a light bulb, comprising a fine filament supported within a glass envelope, must be mounted in a contactor that firmly supports the glass envelope and maintains sufficient electrical continuity between filament leads and two electrical source wire leads. The mechanical strength of the electrical contact must be sufficient to prevent intermittent contact under a variety of operating conditions (vibration, heat, cold, etc.) which could lead to flickering of the light or overheating that might cause a breakdown of insulation between the leads. Accordingly, the concept of the threaded plug and socket evolved whereby a sturdy male plug is screwed into an equally sturdy female receptacle so that the integrity of the glass seal and electrical continuity between filament and wire are maintained.

But with the development of display systems consisting of many light bulbs, the need is not only for an inexpensive contactor but also for a contactor that is amenable to assembly by automatic (production) techniques, and fast manual connect and disconnect which screw-in bulbs are not. The use of "receptacles on cords" for large numbers of lights, such as for Christmas trees, signs, displays and other light arrays, has stimulated a demand for a method of manufacturing electric cords having a large number of receptacles. Thus, a bulb contactor is required to provide continuous firm support to the bulb.

In contrast, the primary requirement for a wire-to-wire connector is to provide positive contacts and low resistance across the junction. There is also a need to reduce the size of wire to wire connectors since they are sometimes closely bunched or bundled in a manner not customary with light bulbs.

Wire-to-wire connectors are sometimes designed to withstand frequent connect and disconnect. Therefore, wire to wire connectors have been developed comprising a male and female part wherein each part has a ductile copper sleeve on one end adapted to enclosing the bare end of a wire and securing to the feed or live wire by a crimp. The engaging (mating) end is made of metal that is a compromise between the requirements for good resistance to breakage due to fatigue and good electrical conductivity. Copper beryllium is an alloy that is often selected for wire to wire connectors as being a good compromise of resiliency and conductivity, with just sufficient strength for the application.

U.S. Pat. No. 3,654,594 is an example of a wire-to-wire connector comprising a male and female spade-type termination part made of resilient metal, each of which is attached to a ductile metal crimpable barrel into which the bared feed wire is inserted and crimped. Assembly of the termination part to the crimpable barrel, and of the wire to the crimpable barrel is performed in two operations. In the first operation, a tab on the termination part is slipped into a retaining groove in the crimpable barrel part. In the second step, the wire is positioned onto the partially formed crimp barrel. The assembly is then punched in a crimping station so as to complete the closure of the crimp barrel and to secure termination, crimp barrel and wire together. Both terminators and crimp barrel are brought to the crimping station as attachments ("cut-outs") along a continuous ribbon.

U.S. Pat. No. 2,806,215 discloses a bi-metallic connector having one end crimped onto a wire and a ring for receiving a bolt at the other end.

U.S. Pat. No. 3,568,137 discloses a bi-metallic connector in which one end is designed for crimping to a wire of relatively small diameter while the second end is designed for crimping onto a wire having a larger diameter.

U.S. Pat. No. 3,320,574 discloses a bi-metallic device for connecting a wire to an electrical receptacle of the type having a receiving hole.

U.S. Pat. No. 4,209,221 discloses a two-piece socket terminal having a threaded socket for spark plugs on one end and a crimpable sleeve on the other end.

The above patents are carefully designed to meet critical requirements of very specific devices, e.g., spark plugs, wire-to-wire junctions, and the like.

THE INVENTION

Objects

It is an object of this invention to provide a bulb contactor assembly that may be inserted into a housing, thereby forming a receptacle to support the bulb and establish electrical contact of the bulb to wires.

It is another object of the invention to provide an improved receptacle assembly to accommodate a bulb having a T-3¼ or T-5 wedge-base type configuration, and method of manufacture of the assembly.

It is another object that the receptacle provide means for holding the bulb firmly in a desired position.

It is another object of this invention to provide a receptacle that is economic from the stand points of cost of materials used in its construction and cost of assembly compared to other devices in the connector art.

Still another object of this invention is to provide a receptacle that may be inserted into any one of a variety of supporting constructions (housings).

These and other objects are evident in the specification.

SUMMARY

This invention is directed to an electrical receptacle including a housing especially adapted to enclose two contactor assemblies, and a method and apparatus for manufacturing the contactors. Each contactor assembly has a clamp that closes onto a terminal of a T-3¼ or T-5 wedge-base type light bulb.

The clamps are fabricated from heat-treated spring steel in order to provide the necessary firm grip to the bulb terminal. Each clamp has a knurled tab which is bound to a bared wire end by a ductile metal strap. The metal strap is selected to provide the necessary electrical conductivity and strength to the union of clamp and wire, and is preferably brass. The clamp tab and inner surface of the crimpable strap are preferably electrotinned.

The assembly apparatus and method combines the clamp, strap and bared conductor wire in a single punch (crimp) operation. In order to provide superior clamping force on the bulb, a requirement where as here, there may be frequent connect/disconnects and vibration, we use spring steel for the clamp member. The clamp is stamped (formed) from the raw spring steel stock and then heat-treated to impart the resiliency. The heat-treating step is performed on the clamp separately before securing the clamp to the wire. The individual bulb clamps are placed in a vibrating bowl (holding bin) that feeds the bulb clamps one at a time along a specially constructed track that aligns the clamp into the required orientation for the punch operation. The straps are attached to a ribbon so that they arrive at the punch station with the desired orientation. The bare-wire conductors are also fed to the punch station so that the tab or tang of the clamp and base-wire end are nested in the H-shaped strap which is then crimped around the wire for excellent electrical contact.

After assembly, two bulb contactor assemblies (having attached wires) are inserted into a support housing in spaced relationship to form the receptacle (socket). A shoulder on the interior surface of the housing first compresses the clamp as it slides past the shoulders. The clamp is then locked into the housing by ears on the clamp that expand back against the shoulder. The exterior of the housing is configured to accommodate one of a number of attachments designed to accept the housing. For example, one configuration has a clip, another configuration has a twist lock, and a third accommodation features a plug.

DETAILED DESCRIPTION OF THE BEST MODE OF CARRYING OUT THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the preferred best mode of carrying out the invention.

Figure 1:
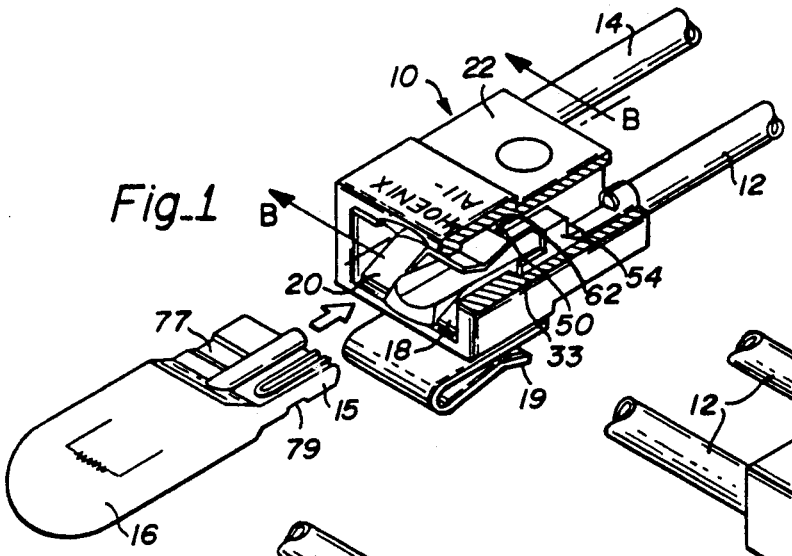
FIG. 1 shows in partial cutaway perspective a receptacle housing having a pair of spaced contactor assemblies comprising the bulb clamp and strap with attached wires, and a bulb positioned for insertion into the contactor assemblies positioned in the receptacle.

FIG. 1 shows a partially cut-away isometric perspective view of the receptacle 10 including the bulb contactor assemblies 18 and 20 to which are joined two wires 12 and 14, and a bulb 16 positioned for insertion into the assembly. Bare ends of wires 12 and 14 are attached to contactor assemblies 18 and 20, respectively which are inserted, spaced apart with open side facing each other, into housing 22. The wedge shaped base 15 of a "T-3¼" or "T-5" type bulb 16 is inserted into the bulb-receiving end of housing 22. The interior of housing 22 is uniquely constructed to provide firm dependable support of the contactor assemblies and bulb.

Figure 3:
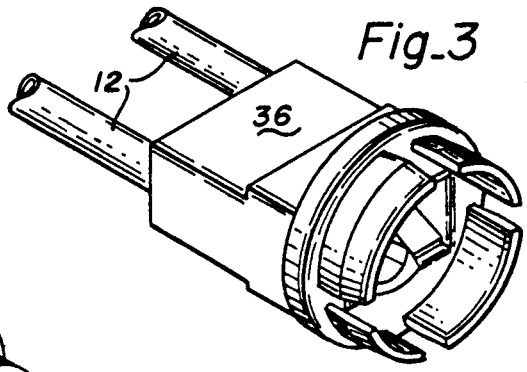
FIG. 3 shows a receptacle housing featuring an external male prong arrangement for attaching to an external female counterpart.
Figure 2:
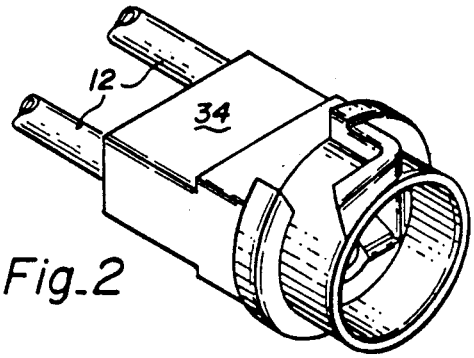
FIG. 2 shows a receptacle housing containing spaced, paired contactor assemblies featuring a twist lock external configuration for external support of the receptacle.

The exterior of the housing may be constructed with one of a variety of shapes in order to accommodate any one of a number of mounting configurations. The mounting configuration of the housing in FIG. 1 includes a clip 19. A twist mounting configuration 34 is shown in FIG. 2, and a hole plug configuration 36 is shown in FIG. 3. All of these housings with various exterior mounting configurations include identical internal configurations to permit bulb and contactor insertion, retention and rigid support.

Figure 13:
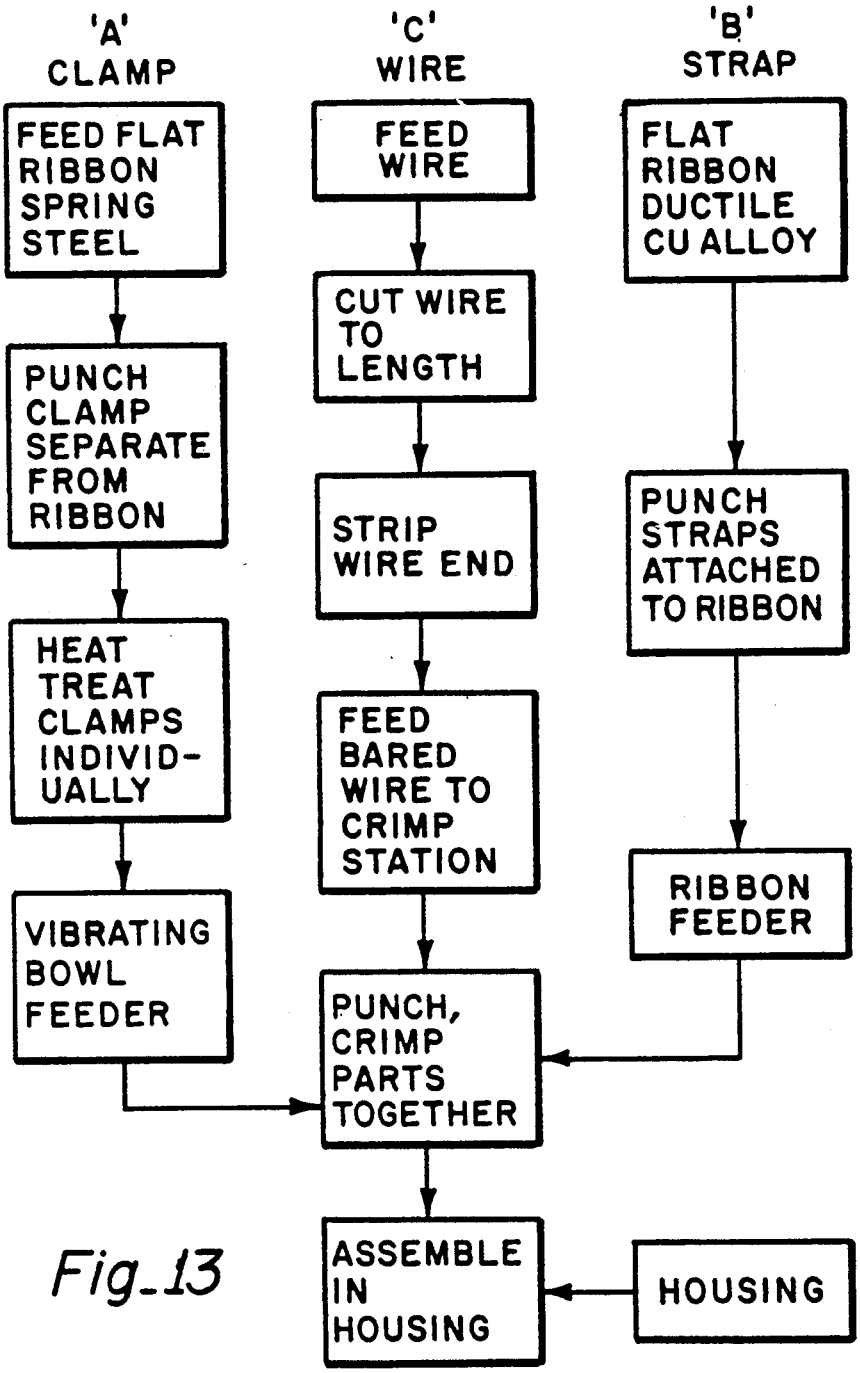
FIG. 13 is a schematic outline of the method of assembling the light bulb assembly.

The method of assembling the contactor assembly and inserting into the housing is summarized by the flow chart, FIG. 13.

There are shown three branches A, B and C corresponding to preparation of the bulb clamp, wire, and strap which converge to form the bulb contactor assembly, followed by insertion into the housing. The flow chart FIG. 13 shows these branches:

A. in which a steel ribbon is formed into a clamp and fed to the punch station;

B. in which a ribbon of copper alloy is formed into a strap and fed to the punch station; and C. in which a wire is cut, insulation trimmed from the end, and fed to the punch station and then the clamp, bared wire end and strap are crimped together and inserted in the housing.

Further discussion of details of the steps in each branch are presented in the following paragraphs.

Figure 4:
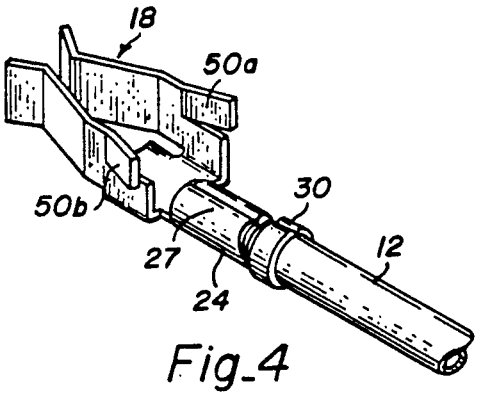
FIG. 4 shows a bulb clamp, strap and bared wire end, assembled and crimped together for insertion into the housing of FIG. 1, 2 or 3.

FIG. 4 shows an isometric view of contactor assembly 18 attached to a wire 12. Details of the contactor are shown in the disassembled view of FIG. 5. The contactor consists of a bulb clamp 23 and a strap 24 resembling the letter "H" when flat. In order to attach the bulb clamp to the wire 12, the bare end conductor 13 of the wire and the tab 25 on the bulb clamp are positioned in the middle (bottom) 26 of the generally U-shaped strap 24. The assembly is then punched (crimped) so that the main section 27 of the strap closes around the tab 25 and bare wire 13. The wire arms section 30 of tab 24 closes around insulation on the wire. The tab has knurls on the surface preferably transversely across the width of the tab, in order to increase frictional grip on the wire end 13 and establish good mechanical strength of the union of tab to the wire.

The strap may be fed to the punch station in either one of several configurations. In one configuration illustrated in FIG. 10 the strap is provided as a slotted ribbon 11. In the punch station, the ribbon is cut along spaced-apart lines C—C in FIG. 10 to provide the separate strap having two sections; main section 27 to be wrapped around the tab and bare wire, the wire safety section 30 to be wrapped around the insulated section of wire 12.

Figure 11:
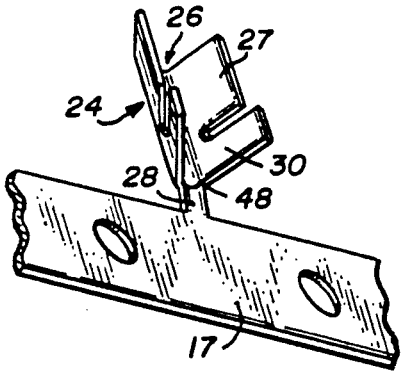
FIG. 11 shows another arrangement of the strap attached to the ribbon at its edge.

In another configuration shown in FIG. 11, the strap has a shape like the letter "H" which is joined at the midpoint of wire safety section 30 to a ribbon 17. The punch, in one operation separates strap 24 from ribbon 17 along the web juncture, 48. This is the preferred configuration and wraps legs 27 of the H shaped strap around the tabl and bare wire end, and the other legs 30 are wrapped around an insulated section of the wire.

Figure 5:
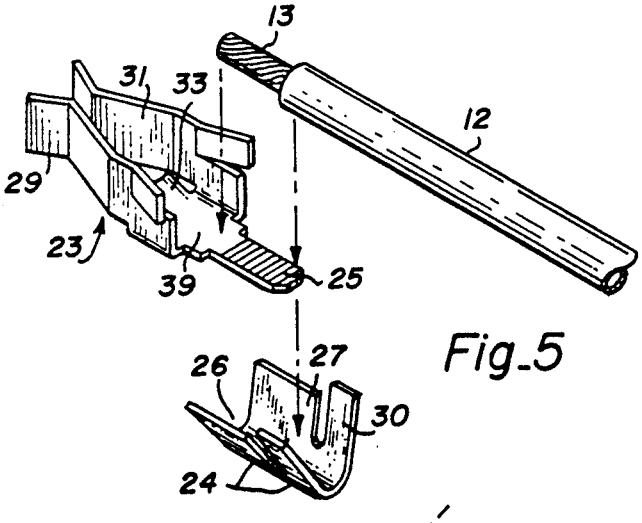
FIG. 5 shows an exploded, dissembled view of strap, bulb clamp and bared wire end approximately positioned for crimping.
Figure 9:
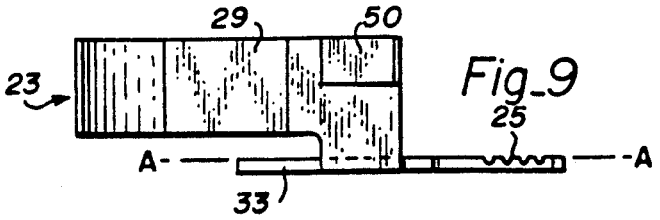
FIG. 9 shows a side elevation view of a bulb clamp.
Figure 8:
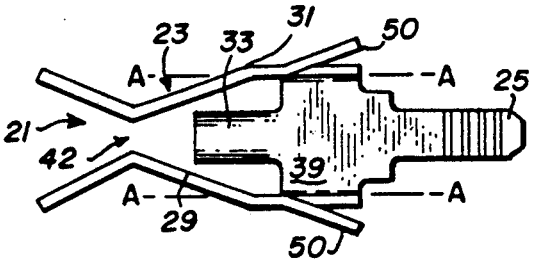
FIG. 8 shows a plan view of a bulb clamp.

Additional structural features which accommodate the bulb clamp to the housing bulb, and are shown in the isometric view in FIG. 5, plan view in FIG. 8 and the elevation view in FIG. 9.

Figure 12:
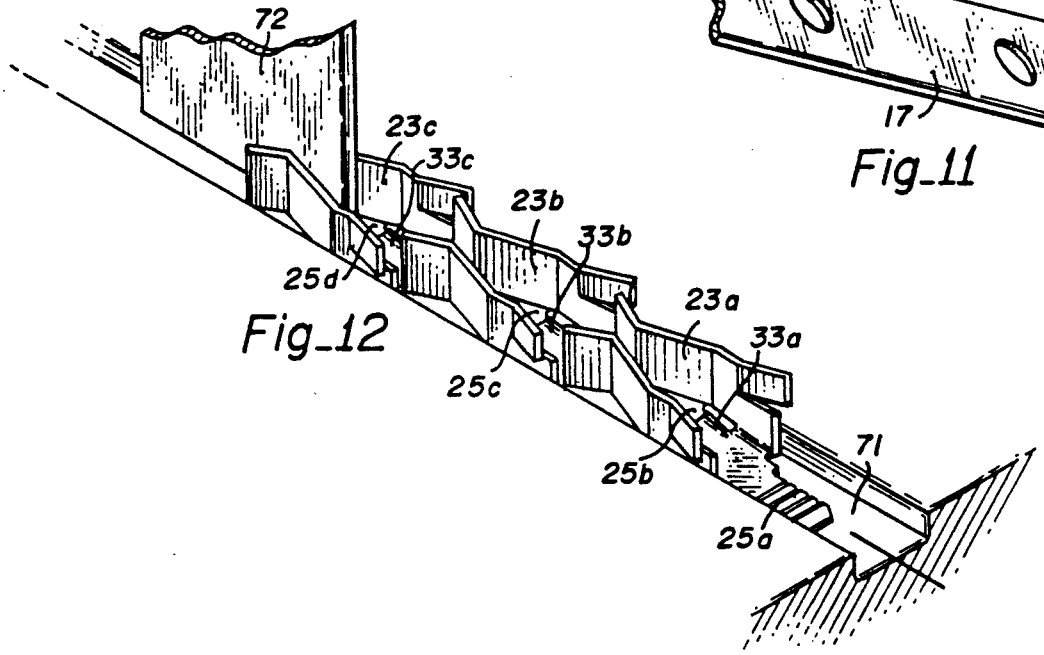
FIG. 12 shows features of the track and clamp construction for aligning the clamp preparatory to arrival at the punch station.

The clamp 23 is formed by stamping out a flat configuration that is then bent along two lines "A" (FIG. 8) to form a channel. The opposing legs 29 and 31 of the channel are connected by a flat panel 39 (FIG. 8). As shown in FIGS. 5, 8, 9, and 10 the panel member has a knurled tab 25 on the end opposite the legs 29 and 31. A spacing tab 33 is disposed on the other end of panel 39, which tab 33 cooperates with the internal conformation of the housing 22 in FIG. 1, or housing 34 in FIG. 2, or housing 36 in FIG. 3 of the receptacle assembly to ensure alignment of the bulb contactor inside the housing. An aligning shoulder, 54, on the internal surface of the housing shown in FIGS. 1 and 7 mates with the spacing tab. As seen in FIG. 12 the spacing tab 33*a* of a downstream clamp 23*a* abuts tab 25*b* of the next upstream clamp 23*b*. This keeps the clamps from nesting and jamming in feed track 71.

The legs 29 and 31 (FIGS. 5 and 8) of the channel (bulb contactor clamp) 23 are configured to perform two functions. The wasp shaped region (42 in FIG. 8) is formed by spaced, opposed V-shaped legs providing a flared opening 21 and a necked-down region 42. This provides a pincher, or clamp-type detent, which securingly mates with (engages) notches 77 and 79 on opposite sides, respectively of the wedge-shaped terminal section 15 of the bulb (see FIG. 1), so that the bulb is mechanically secured when the wedge end is forced between the channel legs of the bulb clamp.

Figure 7:
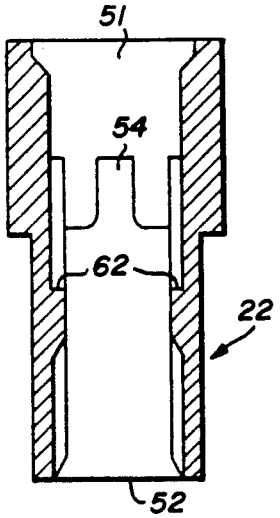
FIG. 7 shows a cross sectional view of the housing taken along line, B—B of FIG. 1.

The second function of the channels is to secure the bulb clamps in the housing. This is accomplished with ears 50*a*, 50*b* at the opposite end of the clamping legs (FIGS. 1 and 4). The manner by which the bulb clamp is secured in the housing is illustrated by referring to the plan view of FIG. 8, the elevation view of FIG. 9, and the assembled view in FIG. 1. The cross-sectional view of the housing shown in FIG. 7 is taken along line BB in FIG. 1. There is shown in FIG. 7 the housing 22 with one open end 51 for insertion of the bulb wedge and a second open end 52 for insertion of the bulb clamp. Shoulder 54 in the housing mates with the spacing tab 33 on the bulb clamp shown in FIG. 8 and 9. As the bulb clamp slides into the housing, ears 50*a, b* spring into locking position against internal shoulders 62.

In order to achieve the high degree of resiliency and strength necessary to support the bulb and retain the wire, the clamps are made from heat-treated spring steel. We have found that heat treated spring steel provides better performance than materials such as beryllium copper because of its greater strength and resiliency. Although electrical conductivity of heat treated spring steel is not as great as that of copper alloys such as beryllium copper, electrical conductivity is not as important a consideration as with the case of wire to wire terminations because of the larger resistance of the bulb filament. Further the knurling and electrotinning of tab 25 followed by high pressure crimping of strap 24 to bring wire 13 into good mechanical contact with the tab 25 forms a very serviceable electric contact.

Because of the requirement to fabricate the clamp by a stamping operation followed by heat treating, it is necessary to bring each clamp to the punch station as a separate part rather than attached to a ribbon as is done in manufacturing of other types of connectors such as the wire connectors described in the prior art. Therefore, the clamp has been configured and an assembly apparatus has been constructed which enables the assembly to be produced using automatic techniques. The clamp configuration and apparatus are embodiments of this invention.

Figure 6:
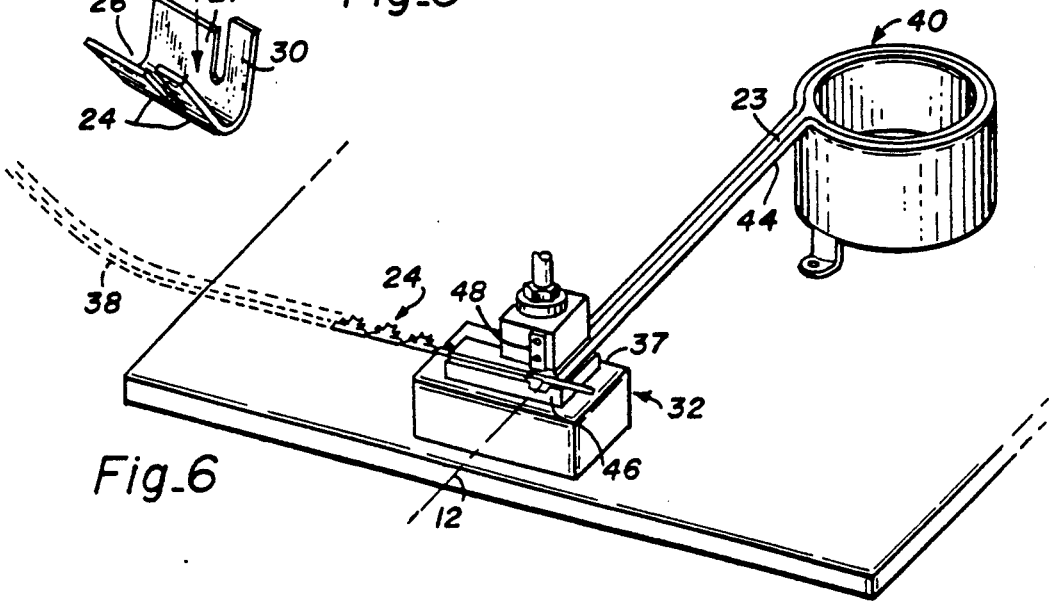
FIG. 6 shows the feeding and crimping apparatus for assembling and crimping the bulb clamp, strap and bared wire.
Figure 10:
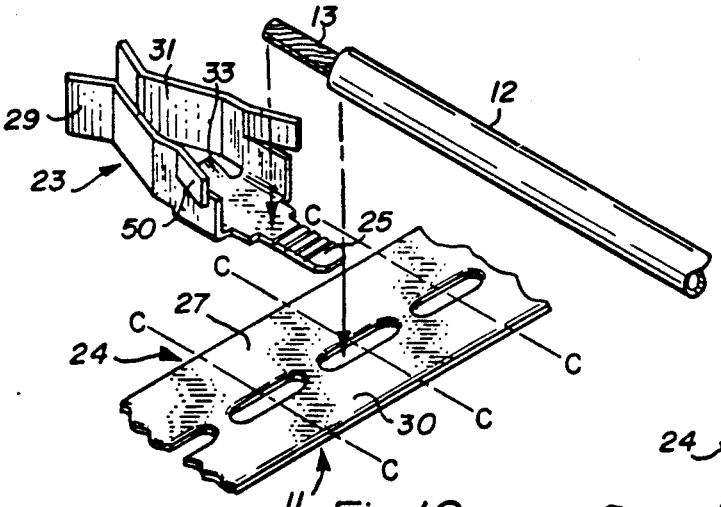
FIG. 10 shows a dissembled view of strap, bulb clamp and bared wire end approximately positioned for crimping where the strap is part of a ribbon.

The assembly and punch operation is performed with a punch assembly apparatus shown in FIG. 6. The apparatus 32 includes a punch press (cutaway in FIG. 6) with punch area 37 to which is brought the bared end of wire 12, a reel mechanism (not shown) which supplies strap strip 38 having multiple spaced straps 24 connected by tabs (as shown in FIG. 10 or 11). A vibrating feeder bowl 40 which orients and feeds the individual bulb clamps 23 one by one along bowl track 44 to the crimping die and anvil assembly 46.

The wire end, bulb clamp and strap all arrive at the punch station simultaneously where they are automatically properly positioned between anvil and die of the crimp applicator 46. Positioning the wire to the clamp and barrel closes an electrical circuit triggering the press to stampingly crimp the three parts together.

The features of clamp and track constructions which permit orientation and consecutive feeding of the clamps to the punch station are illustrated in FIG. 12. There are shown three clamps 23 aligned in the track groove 71 and moving in the direction of the arrow. Each clamp has been contacted by the orienting bar, 72, which either knocks a misaligned clamp back into the vibrating bowl or aligns the clamp, permitting it to slip into the track.

The spacing tab (33 in FIG. 8 and 9) also serves an indispensable function in cooperation with the vibrating feed mechanism. It lowers the center of gravity of the clamp so that the clamp in the feeder bowl will always flip over onto its flat side. The shift in center of gravity toward the spacing tab also causes the clamp on an incline to orient with the electrical contact tab 25 always pointing "downhill". Another function of the spacing tab 33 is to butt against the preceding contact tab 25 to assume proper spacing in the track of the feeder bowl and prevent nesting and jamming.

The features of this invention have been illustrated for the embodiment where one wire end is attached to each bulb clamp assembly. In some applications it is required to attach more than one wire to each bulb clamp assembly, and this configuration is another embodiment of this invention.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. A bulb receptacle assembly for supporting a light bulb and maintaining electrical continuity between each terminal of said bulb and one end of each of a pair of electric source wire which includes:

(a) a pair of bulb contactors, each contactor comprising a heat treated spring steel channel member having two opposing upstanding spaced-apart sides connected by a panel there between and having one rearward edge of said panel contiguous with a first tab and an opposing forward edge contiguous with a second tab;

(b) a ductile metal strap wrapped around said wire end and said first tab;

(c) a generally tubular housing having a first opening on a first end of said housing to receive said terminal section, and an opening in an opposite end of said housing to receive both bulb contactors forming said pair of bulb contactors;

(d) said housing having an internal surface with a groove aligningly engaged with said second tab; and (e) means for securing said contactor channels inside said housing.

2. A bulb receptacle assembly as in claim 1 wherein:

(a) said strap is generally H-shaped, with a forward pair of arms and a rearward pair of arms;

(b) said arm pairs being connected by an intermediate section having a lateral width less than the width of said pairs of arms;

(c) said forward strap arms being of length sufficient to be crimpingly wrappable around said a bared end of said electrical source wire with said tab secured intermediate there of for good electrical connection; and (d) said rearward pair of strap arms being of length sufficient to be crimpingly wrappable around said insulation of said electrical source wire to mechanically secure said wire to said channel member and prevent pulling on said wire from interrupting electrical contact between said bared wire end and said tab.

3. A bulb receptacle assembly as in claim 2 wherein:

(a) said channel member sides are bent medially of their ends toward each other to form a reduced spacing there between.

4. A bulb receptacle assembly as in claim 3 wherein:

(a) said forward channel member sides are bent outwardly from each other to form a flared entry to permit easy insertion of a bulb.

5. A bulb receptacle assembly as in claim 4 wherein at least a portion of one of said channel sides includes a portion bent outwardly there of to form an ear for engagement with a housing.

6. A bulb receptacle assembly as in claim 5 wherein:

(a) each of said opposed channel sides having an ear portion formed therein, and said connector channel securing means includes: a shoulder disposed in said housing to engage each of said ears.

7. A bulb receptacle assembly as in claim 6 wherein:

(a) said panel is configured with a forward end portion that is engageable with said tab of a next adjacent channel member when placed in a line, said forward end portion and said tab cooperating to prevent nesting of said channel members in said row.

8. A bulb contactor assembly for mechanically releasably engaging terminals of at light bulb with good electrical connection to a bared end of at least one insulated electrical source wire, comprising in operative combination:

(a) a heat treated spring steel channel member having opposing, upstanding spaced apart sides, each of said sides having a forward and a rearward end, a base edge and a top edge;

(b) said sides being connected along said base edge by a panel:

(i) said panel extending from said rear side ends medially of said sides;

(ii) said panel is configured with a forward end portion that is engageable with said tab of a next adjacent channel member when placed in a line, said forward end portion of said panel and said tab of said next adjacent channel member cooperating to prevent nesting of said channel members in said line;.

(c) said panel having a tab portion extending rearwardly of the rearward end of said channel sides, and said tab has at least one knurled surface to improve mechanical strength of the union with said bared wire;

(d) a ductile metal strap having at least one portion tightly wrapped around said bared end of said wire and securing said tab between said strap and said bared wire to provide said good electrical connection between said bared wire and said tab;

(i) said strap is generally H-shaped, with a forward pair of arms and a rearward pair of arms;

(ii) said arm pairs being connected by an intermediate section having a lateral width less than the width of said pairs of arms;

(iii) said forward strap arms being of length sufficient to be crimpingly wrappable around said bared end of said electrical source wire with said tab secured intermediate thereof for good electrical connection; and (iv) said rearward pair of strap arms being of length sufficient to be crimpingly wrappable around said insulation of said electrical source wire to mechanically secure said wire to said channel member and prevent pulling on said wire from interrupting electrical contact between said bared wire end and said tab;

(e) said channel sides in combination being configured to resiliently clampingly secure at least one of said light bulb terminals to provide secure mechanical engagement of said light bulb under service conditions including vibration, as well as repeated removal and insertion of light bulbs;

(i) said channel member sides being bent medially of their ends toward each other to form a reduced spacing therebetween; and (ii) said forward channel member sides being bent outwardly from each other to form a flared entry to permit ease of insertion of a bulb.

9. A bulb contactor as in claim 8 wherein at least a portion of one of said channel sides includes a portion bent outwardly thereof to form an ear for engagement with a housing.

* * * * *